US010073487B2

(12) United States Patent
Smith et al.

(10) Patent No.: US 10,073,487 B2
(45) Date of Patent: Sep. 11, 2018

(54) SYSTEMS AND METHODS FOR SELF-CONTAINED ADJUSTABLE SPRING PLUNGER BUMPER WITH HIGH INITIAL LOAD AND LOW FINAL LOAD

(71) Applicant: Prince Industries, Inc., Carol Stream, IL (US)

(72) Inventors: David Paul Smith, Wilmington, IL (US); Kevin Alan Brown, St. Charles, IL (US)

(73) Assignee: Prince Industries, Inc., Carol Stream, IL (US)

( * ) Notice: Subject to any disclaimer, the term of this patent is extended or adjusted under 35 U.S.C. 154(b) by 0 days.

(21) Appl. No.: 14/977,358

(22) Filed: Dec. 21, 2015

(65) Prior Publication Data

US 2016/0179127 A1 Jun. 23, 2016

Related U.S. Application Data

(60) Provisional application No. 62/095,057, filed on Dec. 21, 2014.

(51) Int. Cl.
*G05G 5/06* (2006.01)
*G05G 5/03* (2008.04)

(52) U.S. Cl.
CPC ..... *G05G 5/03* (2013.01); *G05G 5/065* (2013.01)

(58) Field of Classification Search
CPC ..... G05G 5/03; G05G 5/065
See application file for complete search history.

(56) References Cited

U.S. PATENT DOCUMENTS

| | | | | |
|---|---|---|---|---|
| RE24,496 | E | 7/1958 | Cornelius | |
| 3,174,500 | A * | 3/1965 | Johnson | C01G 43/06 137/116.3 |
| 3,476,148 | A | 11/1969 | McMillen | |
| 3,625,475 | A * | 12/1971 | Stephens | F16K 11/0704 251/71 |
| 4,260,132 | A | 4/1981 | Habiger | |
| 4,342,335 | A * | 8/1982 | Reinicker | F15B 13/0422 137/596 |
| 6,394,431 | B1 | 5/2002 | Smith | |
| 6,543,971 | B2 * | 4/2003 | Mawhinney | B23B 49/005 408/139 |
| 6,634,383 | B2 * | 10/2003 | Aarestad | F15B 13/0422 137/636.1 |
| 2003/0150079 | A1 * | 8/2003 | Takai | B60B 33/08 16/26 |

* cited by examiner

*Primary Examiner* — Vicky A Johnson
(74) *Attorney, Agent, or Firm* — Barich IP Law Group

(57) ABSTRACT

A system and method is provided for an adjustable spring plunger bumper with high initial load and low final load. The spring plunger bumper includes an exterior body surrounding a plunger. The plunger has a plunger indent into which a displacement ball is induced by a ramp sleeve biased by a ramp sleeve spring. As the plunger is displaced relative to the exterior body, the displacement ball contacts a lower displacement ball inclined surface, which provides a high initial load resisting the displacement of the plunger. However, as the displacement of the plunger continues, the displacement ball comes into contact with a smooth lower displacement ball indent surface which provides a lower load. A return spring is positioned between the plunger and the exterior body to return them to their initial position relative to each other when the displacement of the plunger is removed.

12 Claims, 8 Drawing Sheets

SYSTEMS AND METHODS FOR SELF-CONTAINED ADJUSTABLE SPRING PLUNGER BUMPER WITH HIGH INITIAL LOAD AND LOW FINAL LOAD

CROSS-REFERENCE TO RELATED APPLICATIONS

The present application claims the benefit of U.S. Provisional Application No. 62/095,057, filed Dec. 21, 2014, entitled "Self-Contained Spring Plunger Bumper With High Initial Load and Low Final Load", which is hereby incorporated by reference in its entirety.

BACKGROUND OF THE INVENTION

The present invention generally relates to spring plunger bumpers. More particularly, the present invention generally related to spring plunger bumpers having a high initial load and a low final load.

Spring plunger bumpers are used in many applications and typically have high initial load and then slightly higher final loads. Conversely, in some applications it is desired to have the final bumper load much lower than the initial load. One such application is a control handle forewarning bumper prior to an electric hold coil detent latch. In this case the lower final load of the bumper improves the electric hold coil latching force.

Additionally, in some applications it is desired to have a higher initial load in a smaller self-contained unit. One such application is machine tool material stock bumpers. The high initial load is typically required to be in a smaller compact size bumper. One such bumper with a high initial load and low final load as shown in U.S. Pat. No. 6,394,431 has a single spring for both the plunger return and for the high initial load.

However, this creates several issues. One issue is the single spring may not always overcome the return friction allowing the plunger to get stuck and not reset for the next bump application. Also to have the single spring create the high initial load the inclined angles multiply this spring force. The higher the force multiplier the higher the contact stress at the ball ramp interface. To have one spring supply both the low return load desired plus the desired high initial load, the force multiplier may cause excessive stress at the ball ramp. Wear at this ball ramp interface then changes the effective inclined angle slightly such that the initial load increases to the point where the bumper may not actuate. Lack of bumper actuation may cause a serious field failure.

Other spring plungers such as shown in U.S. Pat. No. 2,791,914 are self-contained but the final load is higher than the initial load due to the spring rate and may not be suited for certain applications.

Still other ball detent mechanisms such as shown in U.S. Pat. No. 4,260,132 are not self-contained and are an integral part of a valve configuration. One main concern with these designs for example is that the ball retainer is separate from the return spring retainer which is also separate from the large housing body thus creating a large configuration package. The body for example is needed to seal off fluid and causes a large integrated valve configuration. This integration into specific valve configurations prevents these detents from being self-contained as needed in some applications. This type of device such as shown in U.S. Pat. No. 4,260,132 is also not adjustable. Being large, non-adjustable and limited to valve applications the valve ball detents also have added cost making them not practical for some applications.

Other bumpers such as shown in U.S. Pat. No. 3,476,148 are adjustable in setting but use non-conventional leaf spring which may be hard to configure and may have limited durability. This configuration is also not self-contained and not adjustable for bump position.

BRIEF SUMMARY OF THE INVENTION

One embodiment of the present invention provides 1) a bumper having final load much less than the initial load, 2) in a small, self-contained unit, and 3) with an improved spring system that reduced wear when returning the bumper to the pre-set condition. This embodiment addresses the above-mentioned issues and concerns by configuring both a return spring and a high load spring in a self-contained small position adjustable spring plunger unit.

DETAILED DESCRIPTION OF THE INVENTION

Figure 1C:
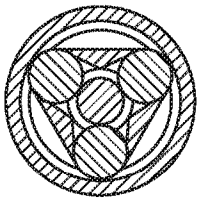
FIG. 1C is a top view of the spring plunger bumper.
Figure 1A:
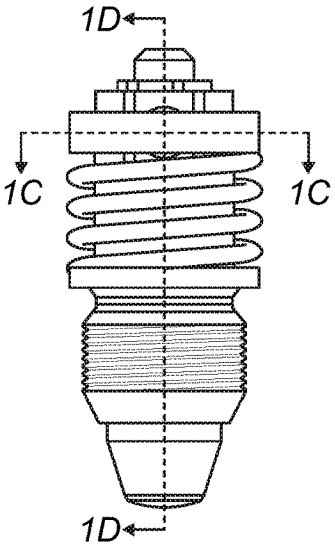
FIG. 1A is a side elevational view of the spring plunger bumper.
Figure 1B:
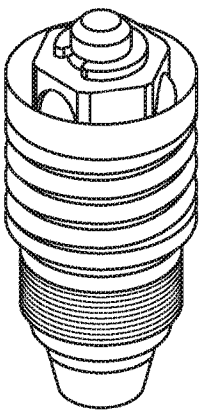
FIG. 1B is an isometric view of the spring plunger bumper.
Figure 1G:
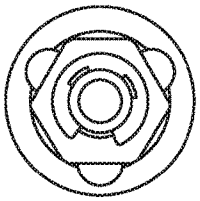
FIG. 1G is a top view of the spring plunger bumper in its fully shifted position.
Figure 1E:
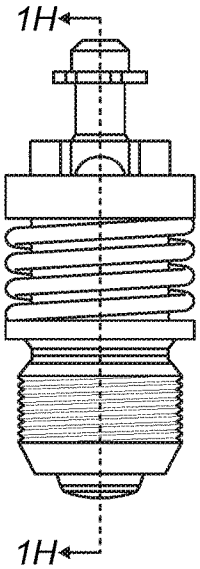
FIG. 1E is a side elevational view of the spring plunger bumper in its fully shifted position.
Figure 1F:
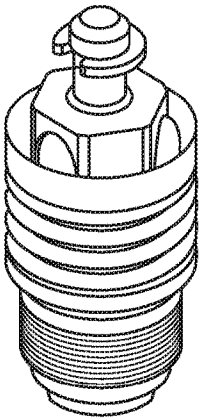
FIG. 1F is an isometric view of the spring plunger bumper in its fully shifted position.

FIG. 1 illustrates several views of a spring plunger bumper 100 according to an embodiment of the present invention. In FIG. 1, FIGS. 1A, 1B, 1C, and 1D show the spring plunger bumper 100 in its neutral re-set position. FIG. 1A is a side elevational view, FIG. 1B is an isometric view, FIG. 1C is a top view, and FIG. 1D is a cut-away view. Similarly, FIGS. 1E, 1F, 1G, and 1H show the spring plunger bumper 100 in its fully shifted position. FIG. 1E is a side elevational view, FIG. 1F is an isometric view, FIG. 1G is a top view, and FIG. 1H is a cut-away view.

The spring plunger bumper 100 includes an exterior body 110, a plunger 120, a return spring 130, a displacement ball 140, a snap ring 150, a ramp sleeve 160, and a ramp sleeve spring 170. The plunger 120 also includes a displacement ball indent 112 having a lower displacement ball indent surface 116 having a slightly larger diameter than indent surface 112 as shown in FIG. 1H. Additionally, the exterior body 110 includes a displacement ball cavity having an upper displacement ball cavity surface 124 and a lower displacement ball cavity surface 122 which may be formed by a drilled passage, for example. Also, the ramp sleeve 160 includes a ramp sleeve displacement ball surface 162. The contact of the ramp sleeve 160 with the ball 140 is preferably perpendicular to surface 162 and is shown for example at 60 degrees.

Figure 1D:
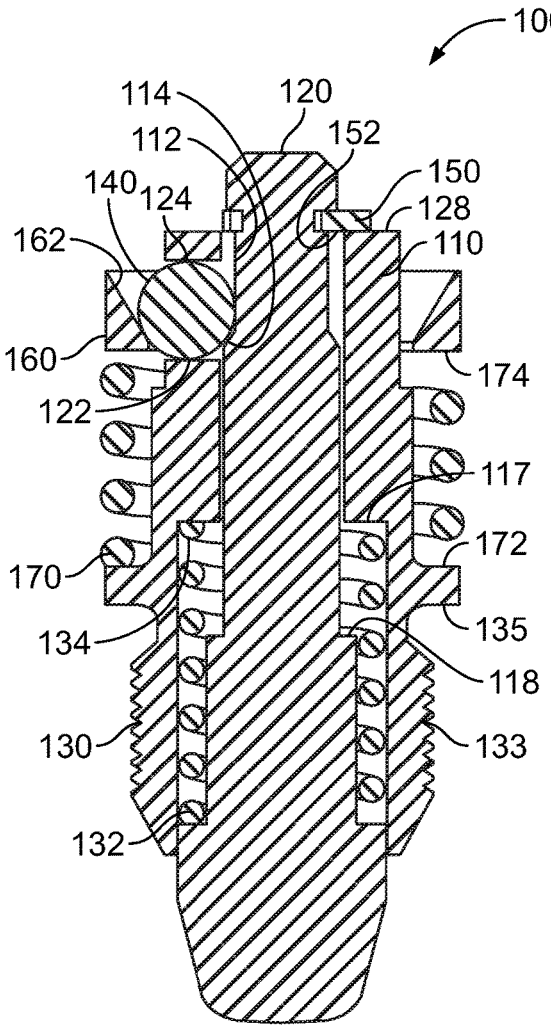
FIG. 1D is a cut-away view of the spring plunger bumper.
Figure 1H:
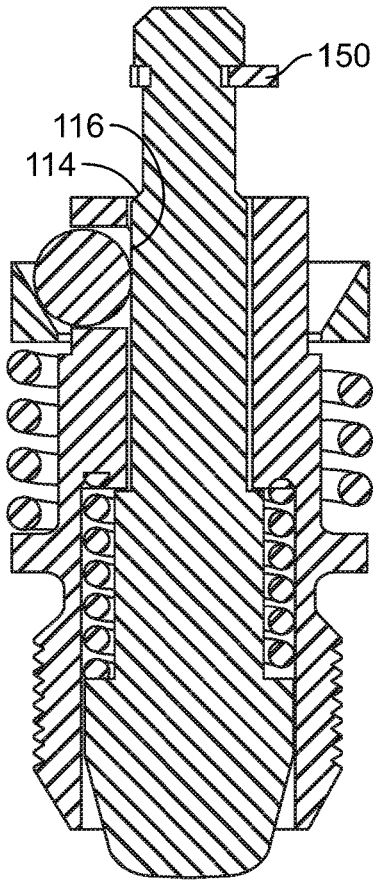
FIG. 1H is a cut-away view of the spring plunger bumper in its fully shifted position.

As shown in FIG. 1D, when the spring plunger bumper 100 is in its neutral re-set position, the displacement ball 140 occupies a cavity generally circumscribed by the ramp sleeve displacement ball surface 162, lower displacement ball cavity surface 122, displacement ball indent 112, and upper displacement ball cavity surface 124. The displacement ball 140 is also in contact or near proximity with the lower displacement ball inclined surface 114 that is between surface 112 and surface 116.

Further, ramp sleeve spring 170 is biasing the ramp sleeve 160 upward so that the ramp sleeve displacement ball surface 162 induces a force on the displacement ball 140 to induce the displacement ball 140 into the displacement ball indent 112 of the plunger 120. Additionally, the ramp sleeve spring 170 is constrained in its expansion between and provides expansion force between the lower ramp sleeve spring surface 172 of the of the exterior body 110 and the upper ramp sleeve spring surface 174 located on the bottom of the ramp sleeve 160.

Additionally, the return spring 130 is constrained in its expansion between and provides expansion force between the lower return spring surface 132 of the plunger 120 and the upper return spring surface 134 of the exterior body 110.

Additionally, a lower snap ring surface 152 of the snap ring 150 contacts an upper plunger surface 128 of the exterior body 110 in the neutral re-set position shown in FIG. 1D.

Figure 4:
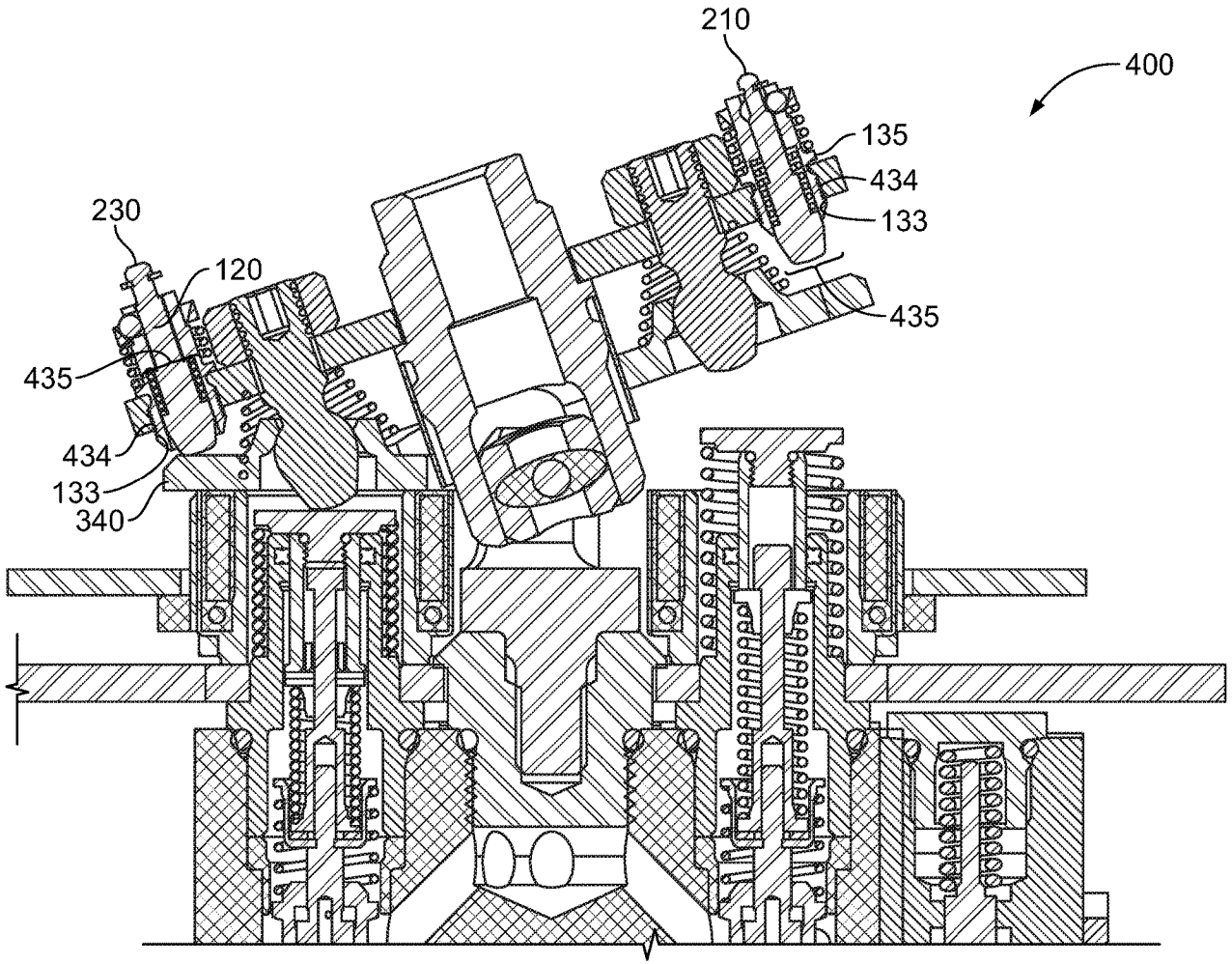
FIG. 4 illustrates an additional cut-away view of the operator control systems of FIGS. 2 and 3 wherein the plunger of the spring plunger bumper has been fully displaced upward and the operator control system has entered into a magnetic latch to fix the angular position of the operator control system at a set angle.

Also, a position adjustment thread 133 is on the outer diameter of the exterior body 110. Typically, this position adjustment thread 133 is engaged into an external body thread (as shown in FIG. 4). Consequently, rotation of the entire spring plunger bumper 100 causes the position adjustment thread 133 to engage the external body thread and may then re-position the spring plunger bumper in the external body thread so as to re-position the bottom surface of plunger 120 relative to an external contact surface (as shown in FIG. 4). A thread locker may be included on position adjustment thread 133 such that once the position adjustment thread has been engaged with the external thread to the extent that the spring plunger bumper 100 is positioned at its desired position, the desired adjustment position of the spring plunger bumper 100 is held in position such that repeated actuation of the plunger 120 does not move the adjusted position. Alternatively, instead of a thread locker, a position-keeping structure such as a mechanical lock may be employed. The maximum amount of adjustment may be limited to a pre-determined amount by an abutment shoulder 135 that limits the travel of the spring plunger bumper 100 in the downward direction. Thus, in one embodiment, as the position adjustment thread 133 is threaded into the external thread, continuing the threading will eventually bring the abutment shoulder 135 into contact with the surface into which the spring plunder bumper 100 is being threaded and thus prevent the position adjustment thread from being advanced further.

In operation, as shown in FIG. 1H, upward force is applied to the bottom surface of the plunger 120. This force is typically applied by an external surface (as shown in FIG. 4) that makes contact with the bottom surface of the plunger 120. As force is applied, the plunger 120 begins to be displaced upward relative to the exterior body 110. As plunger 120 is displaced upward, movement upward is resisted by two components: first, the return spring 130.

Second, as the plunger 120 is displaced upward, the lower displacement ball inclined surface 114 comes into contact with the displacement ball 140, if not already in contact with the displacement ball 140. As the plunger 120 is displaced upward, the lower displacement ball inclined surface 114 induces a force on the displacement ball 140 that is radially outward from the plunger 120. However, opposite the plunger 120, the displacement ball 140 contacts the ramp sleeve displacement surface 162, which is biased by the ramp sleeve spring 170 to resist the radially outward movement of the displacement ball 140.

Consequently, movement of the plunger 120 upward is resisted by both the force provided by the return spring 130 acting directly between the plunger 120 and the exterior body 110, as well as the force provided by the ramp sleeve spring 170 acting to provide an upward force on the ramp sleeve 160 which in turn provides an inwardly radial force on the displacement ball 140, which in turn induced a downward force on the plunger 120.

Figure 5:
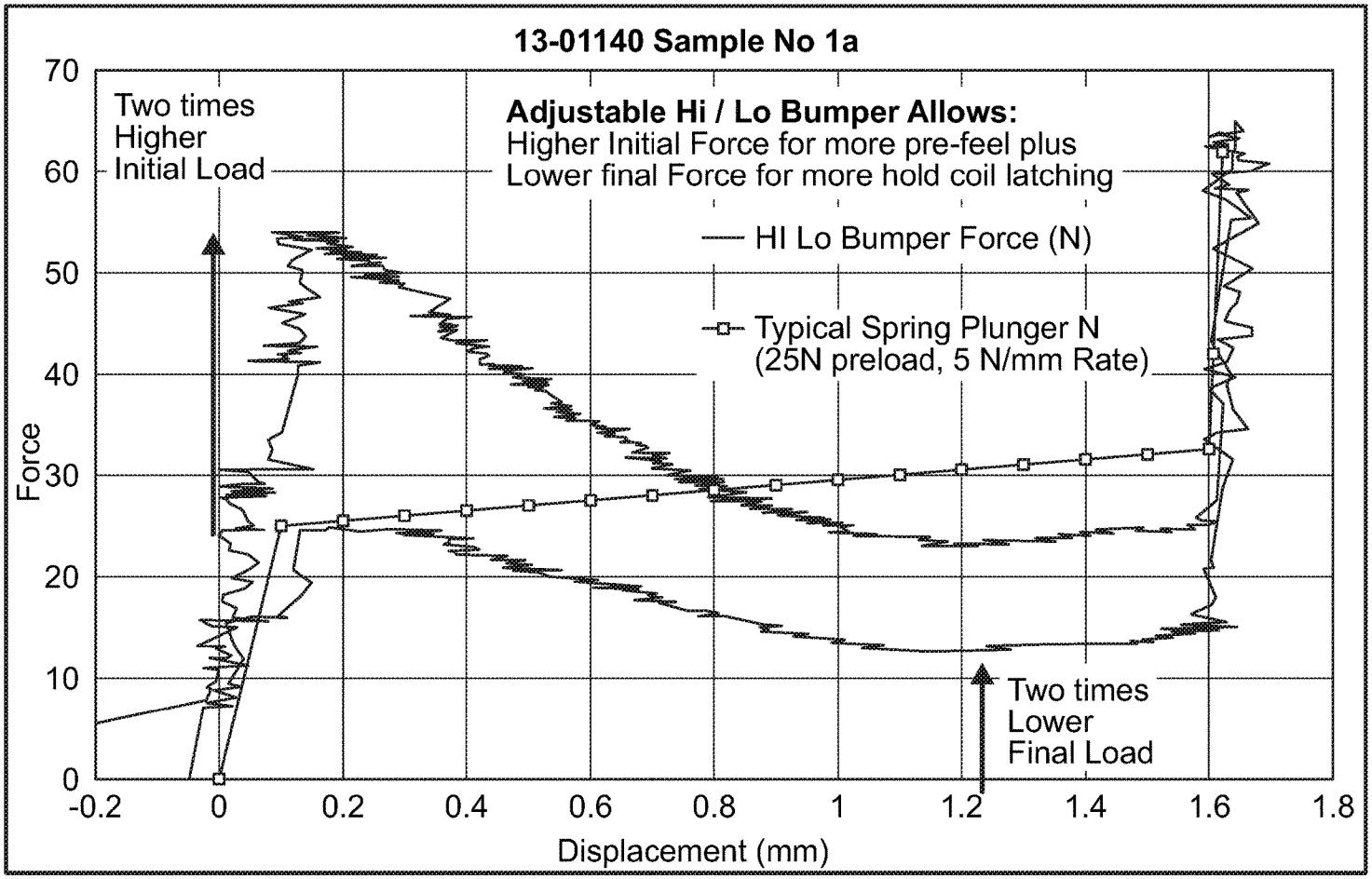
FIG. 5 a graph of experimental results of force vs. displacement for one embodiment of the present invention.

As mentioned above, the angles of the ramp sleeve 160 and lower displacement ball inclined surface 114 are specifically chosen to provide a desired force profile and wear profile. For example for the angles shown in FIG. 1D, the initial high load is equal to the outer spring 122 preload times tan 60°/tan 45° plus the inner spring pre-load. So for a given outer spring pre-load of 21N and inner spring preload of 9N the initial high load is 21*1.73+9=45N. Then the final low load is the inner spring preload or 9N. So the initial high load 45N is 5 times the magnitude of the final low load of 9N. The initial high contact force on the plunger 120 at the inclined surface 114 is equal to the outer spring pre-load times tan 60°/sin 45°. So this contact load is 51N=21*2.45. In this example, the contact load is only 13% higher than the initial high load (51N−45N)/45N=13%) but delivers 5 times higher initial load than the final load. Keeping the high contact load on plunger 120 at inclined surface 114 close to the applied high initial load on the bottom of the plunger 120 allows adequate endurance life of the inclined surface 114 using the same material and heat treatment chosen for the plunger 120 contact at the bottom surface. The actual measured high initial load and low final loads shown in FIG. 5 are for these angles and spring loads. The actual loads are slightly higher due to some minor actuation friction not included in the equations shown.

Although specific embodiments of the various structures of the spring plunger bumper are herein shown and described, many variations are also encompassed within the scope of the present innovation. For example, with regard to the spring loading, in some embodiments, the outer spring may have a larger spring load than the inner spring load. However, in some other embodiments, the spring load may be equal or there may be a larger spring load on the inner spring. Typically the outer spring 170 preload is high and the motion low so the rate of the outer spring may also be higher than the inner spring 130. This higher rate on spring 170 allows this spring to be sized with adequate fatigue life. The motion of the plunger 120 is typically much larger than the motion of the ramp sleeve 160 so the inner spring 130 may have a much lower rate than the outer spring. This lower preload and lower rate on the inner spring 130 allows the spring plunger bumper 100 to have a near constant low final load as seen in FIG. 5.

With regard to the combined structure of the ramp sleeve displacement ball surface 162, displacement ball 140, lower displacement ball inclined surface 114, the components may be "tuned" to increase or decrease the load pickup and other desired elements. For example, the size of the displacement ball 140 relative to the lower displacement ball inclined surface 114 may be increased or decreased so that the contact of the lower displacement ball inclined surface 114 to the displacement ball 140 takes place at a different angle along the exterior of the displacement ball 140. In one embodiment, as the contact of the lower displacement ball inclined surface 114 takes place at an increasing displacement from the bottom portion of the displacement ball 140, less of the upward force induced on the plunger 120 is translated to horizontal movement of the displacement ball 140 and thus the greater perceived resistive force is generated by the displacement ball 140.

Additionally, the number of displacement balls 140 in the plunger 120 may be increased or decreased. Increasing the number of displacement balls may reduce frictional loss and ball loading. For example, a smaller 2 mm ball may be configured allowing 4 balls to be configured in the spring plunger bumper instead of 3. This may reduce the ball contact stress but increases the cost of machining surfaces 122 and 124 plus may increase the assembly cost of the additional displacement ball 140 part.

As mentioned above, the lower displacement ball cavity surface 122 and the upper displacement ball surface 124 may be formed, for example, by drilling. As shown in FIG. 1, the passageway formed by drilling may extend radially outward. Alternatively, the passageway formed by drilling may be angled from radial to produce a different desired reactive force on the displacement ball 140 as the displacement ball 140 is displaced.

Also, although the displacement balls 140 shown in FIG. 1 may have a diameter of 2.5 mm, there is no upper or lower limit on the size of the displacement ball. A larger 3 mm ball may be configured to increase the size of the included surface 114 and reduce contact stress. However a larger ball may cause the overall body 110 to increase in size. This larger overall size may or may not be desired for certain applications.

Additionally, the ramp sleeve displacement ball surface 162 may have an angle greater or lesser than 60 degrees, for example from about 30 degrees to less than 90 degrees. The angle may be tuned with the spring size, especially the outer spring, to produce a desired force profile. Also, the pin angle shown at 45 degrees of surface 114 may be determined by the diameter 112 and diameter 116 and may vary from about 10 to 80 degrees. As shown in FIG. 1, the plunger pin angle is the tangent contact angle with the balls 140 so as the pin angle decreases the initial load increases and the contact load on the plunger pin 120 also increases.

However, as shown in FIG. 1H, once the plunger 120 has been raised by a predetermined distance, the plunger has traveled upward so that the displacement ball 140 has passed the lower displacement ball inclined surface 114 completely and is no longer in the displacement ball diameter 112. At this point, the displacement ball 140 is in contact with a smooth plunger surface 116. Although the ramp sleeve spring 170 is still providing a force on the displacement ball 140 to induce the displacement ball 140 radially inward, because the displacement ball 140 is in contact with the smooth plunger surface rather than the lower displacement ball inclined surface 114, the displacement ball 140 is not able to generate any significant downward force to resist further upward movement of the plunger 120. For example inclined surface 114 is shown as an angled straight chamfer, but this surface may be a curved surface to modify the plunger force and or reduce ball contact wear. Lubricating grease or surface treatments known in the art may be used to reduce friction and or reduce wear. Any or all the contact surfaces for example, may or may not have heat treatment such as "Salt Nitride" and may or may not have friction reducing coating such as "Teflon" and may or may not have lubrication such as "molybdenum disulfide grease" applied, to reduce friction and reduce wear. Also there may be multiple inclined surfaces 114 creating multiple tactile force feedback points of contact with the ball 140. The upward stroke of the plunger 120 may be limited by the contact of an exterior body max stop surface 117 with a plunger max stop surface 118 configured as an abutment surface between the plunger 120 and the body 110 such that the stroke range of the ramp sleeve spring 170 and return spring 130 have adequate cycle life, as shown in FIG. 1H.

Additionally, once the upward force is no longer provided to the plunger 120, the return spring 130 acts to induce a downward motion of the plunger 120 relative to the exterior body 110. The downward motion of the plunger 120 continues until the lower snap ring surface 152 of the snap ring 150 contacts the upper plunger surface 128 of the plunger 120 and the spring plunger bumper 100 has returned to the neutral re-set position shown in FIG. 1D.

Figure 2:
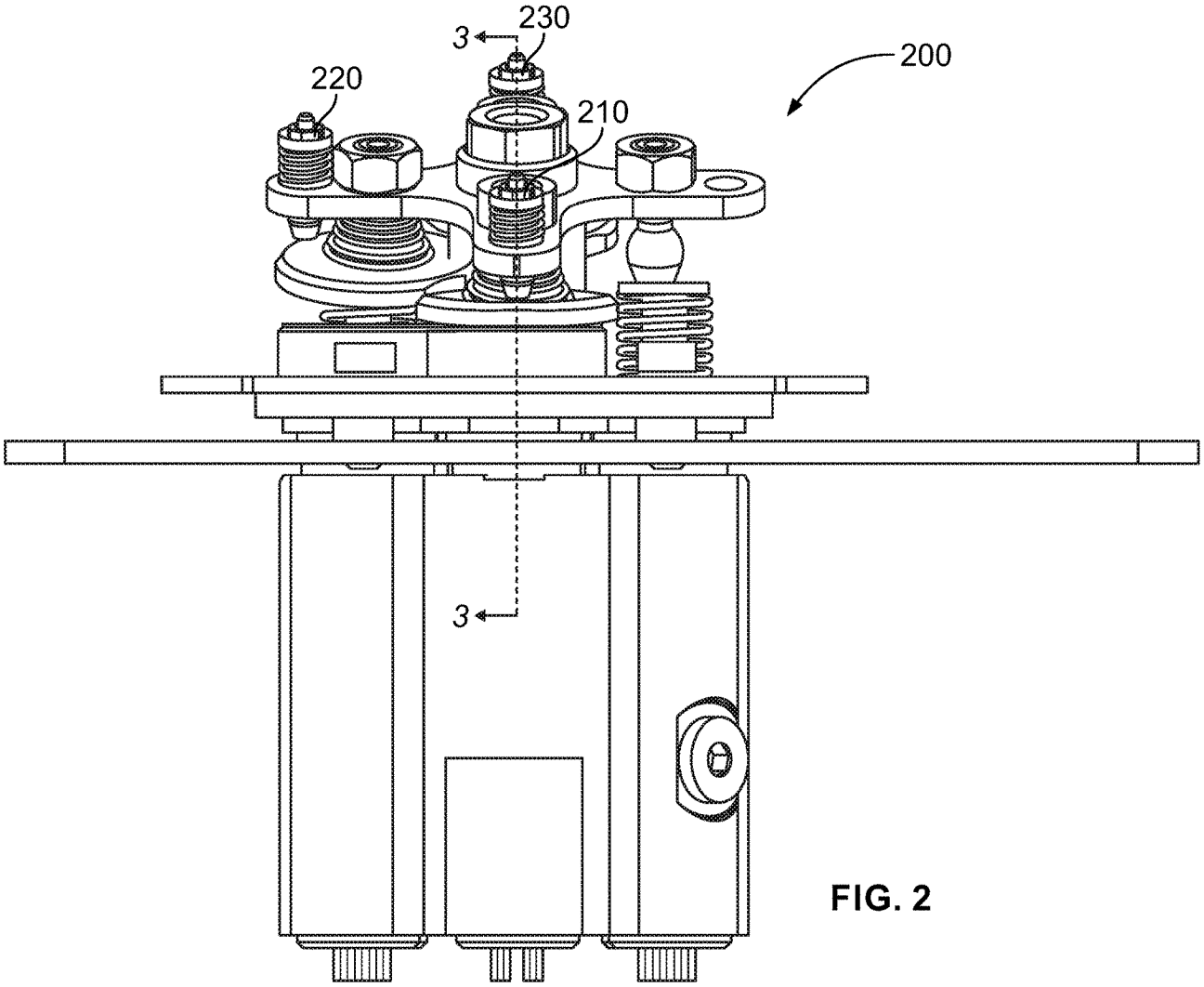
FIG. 2 illustrates a side view of an operator control system including three spring plunger bumpers installed to provide a pilot valve forewarning.

FIG. 2 illustrates a side view of an operator control system including three spring plunger bumpers 210, 220, 230 installed to provide a pilot valve forewarning.

Figure 3:
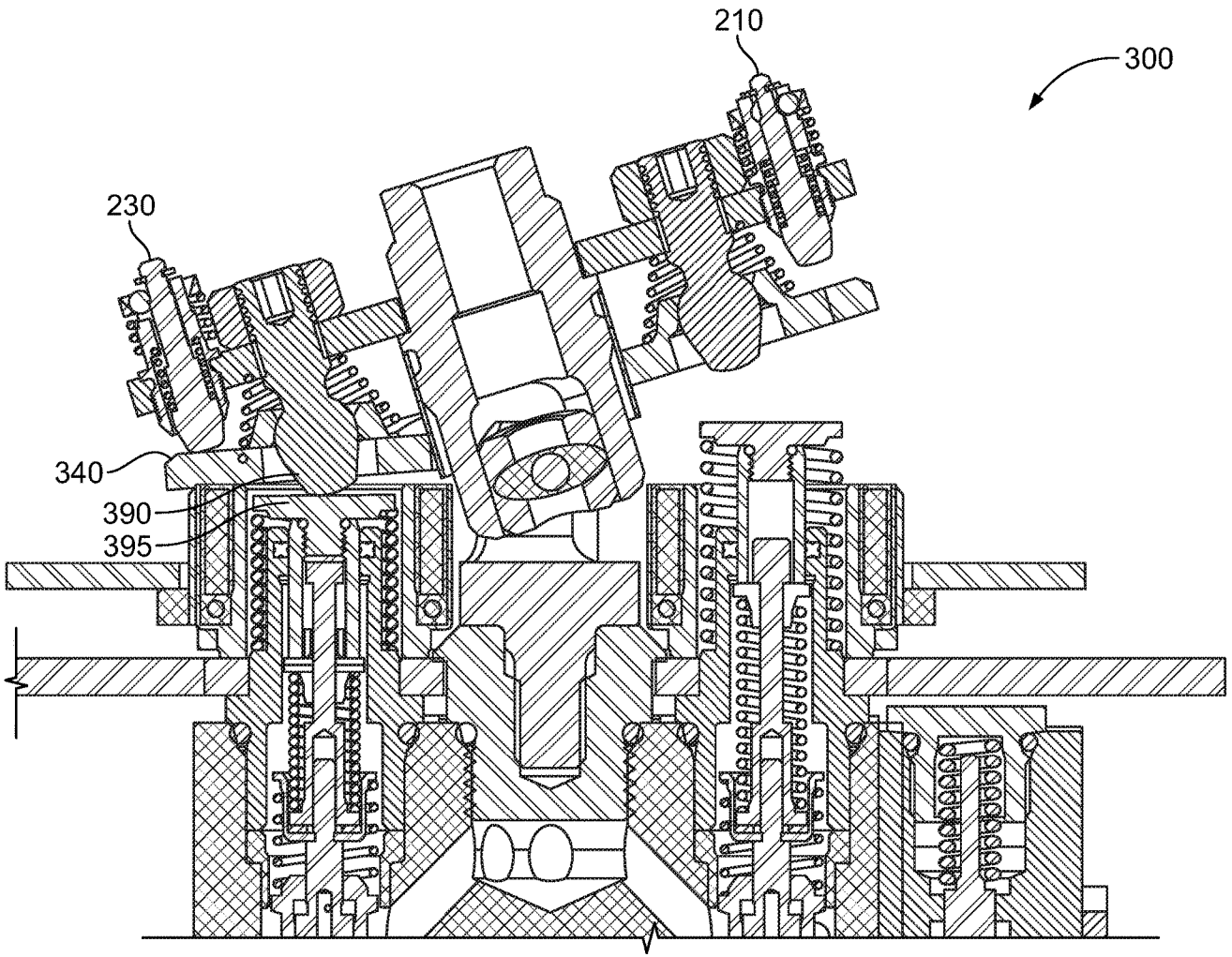
FIG. 3 illustrates a cut-away view of the operator control system of FIG. 2 along section line D-D.

FIG. 3 illustrates a cut-away view 300 of the operator control system of FIG. 2 along section line D-D. As shown in FIG. 3, the operator control includes a pin 390 that has contacted and depressed a valve actuation surface 395 to being operation of the valve. However, as the user continues to increase the angular displacement of the operator control, the bottom surface of the plunger of the spring plunger bumper 230 is brought into contact with the bumper contact and hold coil clapper 340.

Due to the high initial load provided by the spring plunger bumper 230, the contact of the spring plunger bumper 230 with the bumper contact and hold coil clapper 340 is typically readily perceived by the operator. The operator may thus know that the angular displacement produced by the operator is close to entering the hold coil latching angular displacement, which would cause the operator control system to hold the operator control at a fixed angular displacement. Thus the high initial load of the plunger prevents inadvertent operator actuation into the pilot jump-up region and or magnetic latch hold regions as shown in FIG. 5. FIG. 4 illustrates an additional cut-away view 400 of the operator control systems of FIGS. 2 and 3 wherein the plunger 120 of the spring plunger bumper 230 has been fully displaced upward and the operator control system has entered into a magnetic latch to fix the angular position of the operator control system at a set angle. The bumper contact and hold coil clapper 340 is parallel with the hold coil and develops a magnetic latching force.

Additionally, FIG. 4 illustrates position adjustment threads 133 of the spring plunger bumpers 230, 210 engaged with the external threads 434 of the spring plunger bumper apertures 435 of the operator control system. Additionally, spring plunger bumpers 230, 210 have been threaded into the external threads 434 to the extent that the top surface of the spring plunger bumper aperture 435 contacts the abutment shoulder 135. However, as noted above, the spring plunger bumpers 230, 210 may alternately be re-positioned by partially de-threading them from the external threads 434 so as to raise the lower surface of the spring plunger bumper from the hold coil clapper 340. This may be done to alter the angular displacement of the operator control at which the spring plunger bumper contacts the hold coil clapper and thus begins to provide force feedback to the operator control.

Additionally, as further described above, when the angular displacement of the operator control system is reduced, the return spring 130 returns the spring plunger bumper 230 to its pre-set neutral position. This typically requires a negative handle operating torque 620 as shown below in FIG. 6.

FIG. 5 a graph of experimental results of force vs. displacement for one embodiment of the present invention. As shown in FIG. 5, an initial load of approximately double that provided by a single spring plunger system is provided. Additionally, a final load approximately half that of a single spring plunger system is provided.

Figure 6:
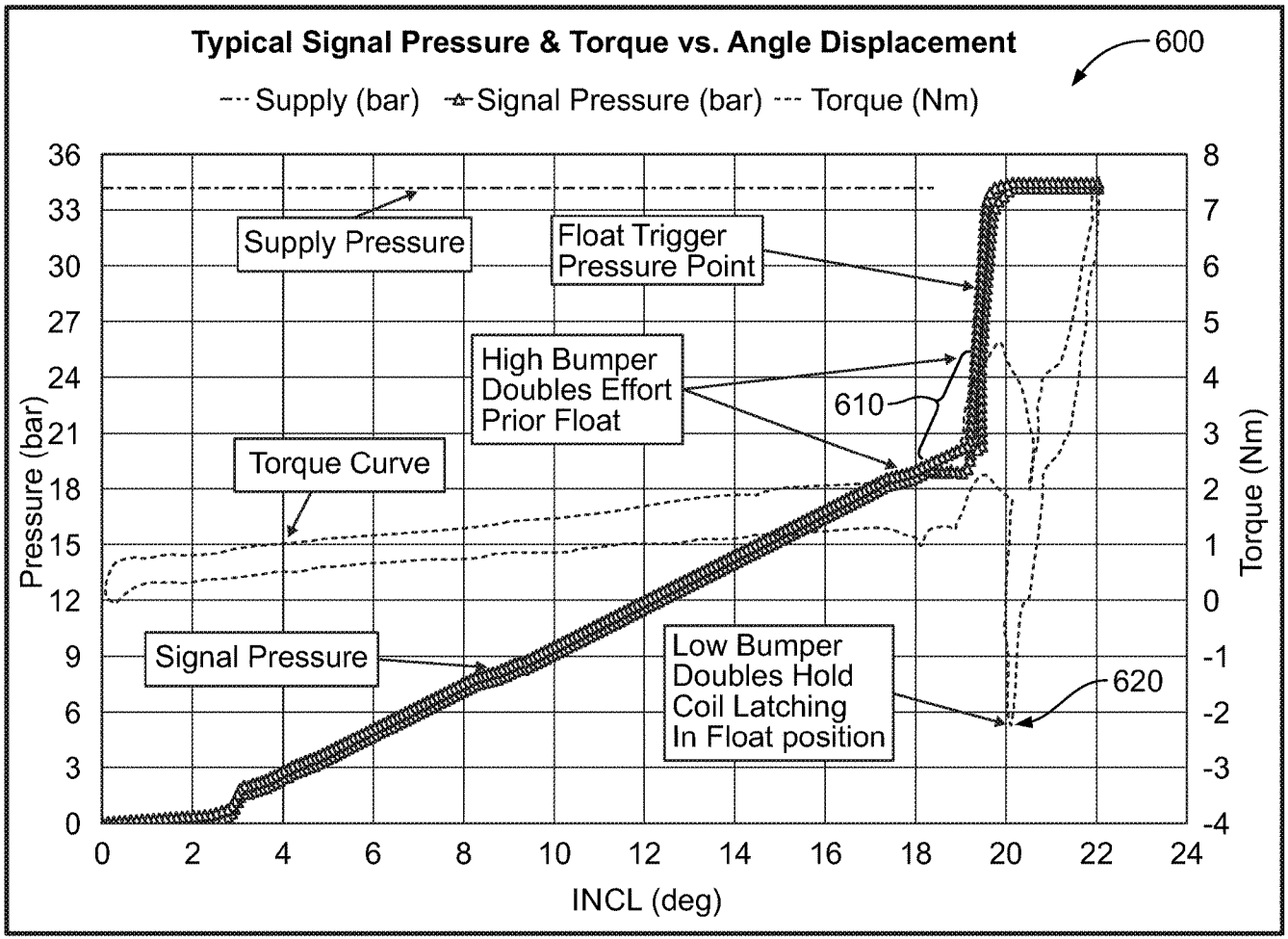
FIG. 6 illustrates a graph of Pressure and Torque vs. inclination or angular displacement of the operator control system in one embodiment of the present invention.

FIG. 6 illustrates a graph 600 of Pressure and Torque vs. inclination or angular displacement of the operator control system in one embodiment of the present invention. That is, although FIG. 5 illustrates the relationship for just the spring plunger system embodiment, FIG. 6 illustrates the relationship for the operator control system as a whole.

As shown in FIG. 6, Torque provided by the operator control system in opposition to user displacement is approximately linear until the spring plunger bumper 230 contacts the bumper contact 340 at region 610. Then, the spring plunger bumper 230 provides a significant increase in load in opposition to operator angular displacement. This operator controlled actuation continues until the angular displacement of the operator control system is sufficient to send the operator control system into float mode. Typically float is triggered by the jump-up of pilot control pressure. The position of the high initial load may be adjusted by rotation of the entire spring plunger bumper 230 in engagement threads 233 such that the high initial load region 610 occurs earlier or later in inclination angle relative to the float trigger pressure point as shown in FIG. 6. In the case of an electronic control the pressure may be an output signal.

Additionally, when releasing from float mode, the addition of the spring plunger bumper 230 doubles the hold coil latching in the float position by greatly reducing the amount of torque that the operator control system is imposing when in the float position, as shown in region 620. Thus, there is less force on the operator control system to return to its neutral position when the operator control system has been angularly displaced into the float position. This may make the system stay in float position more reliably and minimize unexpected or undesired exit from float position.

Figure 7:
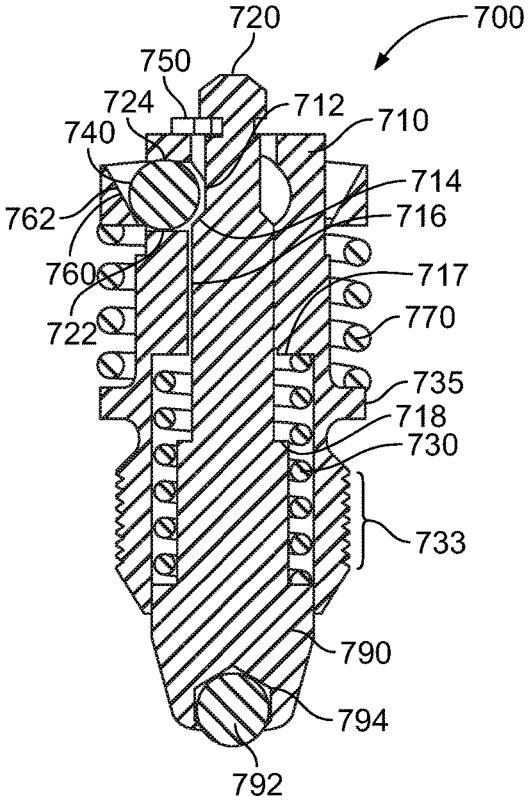
FIG. 7 illustrates a ball-pivot spring plunger bumper as an alternative embodiment of the spring plunger bumper of FIG. 1.

FIG. 7 illustrates a ball-pivot spring plunger bumper 700 as an alternative embodiment of the spring plunger bumper of FIG. 1. Similar to the embodiment of FIG. 1, the ball-pivot spring plunger bumper 700 includes an exterior body 710, a plunger 720, a return spring 730, a displacement ball 740, a snap ring 750, a ramp sleeve 760, and a ramp sleeve spring 770. The plunger 720 also includes a displacement ball indent 712 having a lower displacement ball indent surface 716 having a slightly larger diameter than indent surface 712. An inclined surface 714 on plunger 740 between surface 712 and surface 116 makes contact with the ball 740. An exterior body max stop surface 717 may contact a plunger max stop surface 718 to limit the stroke of plunger 720. Additionally, the exterior body 710 includes a displacement ball cavity having an upper displacement ball cavity surface 724 and a lower displacement ball cavity surface 722 which may be formed by a drilled passage, for example. Also, the ramp sleeve 760 includes a ramp sleeve displacement ball surface 762. The contact of the ramp sleeve 760 with the ball 740 is preferably perpendicular to surface 762 and is shown for example at 60 degrees.

The ball-pivot spring plunger bumper 700 of FIG. 7 is generally similar to the embodiment of FIG. 1, but instead of the base of the plunger being solid as shown in FIG. 1, in FIG. 7, the base of the plunger 790 includes a pivoting ball 792 encased in a pivot ball cavity 794. Thus, in one embodiment, the plunger may have a ball crimped into the nose such that any external contact with a moving surface may have the ball rotate. The position of initial contact of the ball 792 with the external surface may be adjusted by rotation of the entire spring plunger bumper 700 such that the engagement threads 733 thread into an external body which may move the ball 792 position upward or downward relative to an external contact. The maximum amount of adjustment in the downward direction may be limited by the abutment shoulder 735. This ball 792 rolling may reduce friction which also may reduce wear and reduce debris generation important in some applications.

Figure 8:
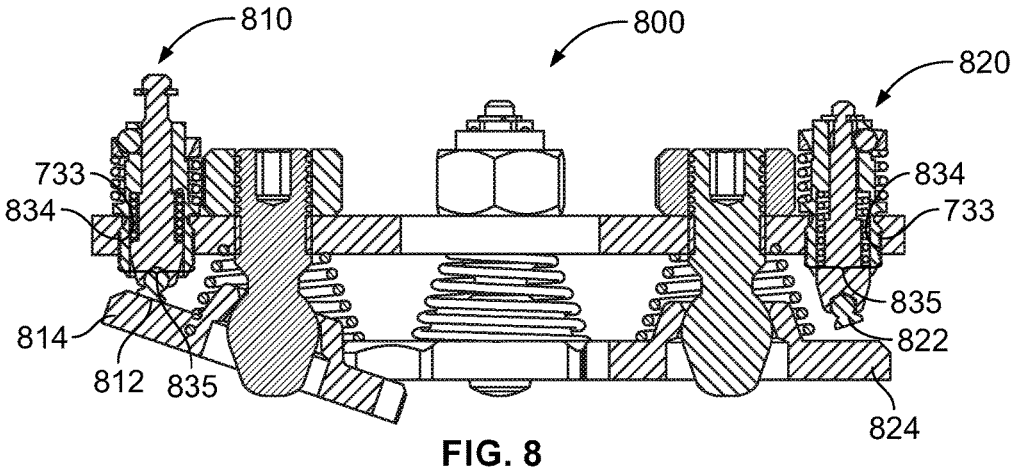
FIG. 8 illustrates an operator control system showing two ball-pivot spring plunger bumpers, a loaded ball-pivot spring plunger bumper and an unloaded ball-pivot spring plunger bumper.

FIG. 8 illustrates an operator control system 800 showing two ball-pivot spring plunger bumpers, a loaded ball-pivot spring plunger bumper 810 and an unloaded ball-pivot spring plunger bumper 820. As shown in FIG. 8, the ball-pivot spring plunger bumpers may have a pivoting ball pad 812, 822 such that the contact with the bumper contact hold coil clappers 814, 824 may be a flat surface. This flat surface contact reduces stress and wear. Reduced wear then reduces debris which may be magnetic and may get between the clapper and the hold coil. Any debris in this pull face gap may reduce the hold coil latching force.

Additionally, similar to FIG. 4 above, FIG. 8 shows the engagement threads 733 of the spring plunger bumpers 810, 820 have been threaded into the exterior threads 834 of the spring plunger bumper apertures 835 of the operator control system.

The position of initial contact of the ball flat surface 812 with the external surface of the hold coil clapper 814 may be adjusted by rotation of the entire spring plunger bumper 810 such that the engagement threads 833 pivot mechanism 800 moves the ball flat 812 position upward or downward relative to the contact with hold clapper 814.

An implementation example for one embodiment of the present spring plunger bumper is discussed below. Pilot valves sometimes prefer fore-warning feel bumper as a tactile feedback to the controls operator. This fore-warning feel force is preferably high so that other functions such as implement float and hold coil latching are prevented from being inadvertently actuated. The stroke of the high-low spring plunger is preferably enough to allow the other functions to be actuated. Then the final load is preferably low since this load takes away from the electric hold coil latching force.

Once the lever is pulled out of hold coil latching the spring plunger is re-set to neutral position. The high-low spring plunger is preferably adjustable so that the initial contact is made at a position that allows full pilot valve function modulation without going into the pressure jump-up region. This position of the initial high load may be done during normal pilot valve testing by turning the bumper until the high load torque increase is positioned at the desired valve output pressure signal. Some pilot curves may not have a pressure jump-up and then the spring plunger bump position is set to be prior to hold coil latch. Additionally, a bump position may be set for other reasons and other positions. For example the pilot valve may have bump position set for a special implement function level that improves performance or prevents engine stall. Another example is a pilot valve that has an on/off switch configured with a forewarning bumper. On a joystick pilot valve adjacent functions may be desired to latch simultaneously. This may increase the stroke demand on the high-low spring plunger. Also the pilot valve may be a single lever axis type. The high low spring plunger may be configured on those valves in a similar manor. Electronic joystick and single lever controls may in similar manor be configured and benefit from this high-low spring plunger. Many other applications besides pilot valves and electronic control joysticks may benefit from a high-low spring plunger. Examples include machine tool locating bumpers and door or drawer bumpers.

The pilot valve curves shown in FIG. 6 show the force as well as the output signal versus actuation angle. In this case the output signal is pilot pressure, but this may also be an electronic joystick signal. The high initial load of this spring plunger bumper 100 is set prior to the jump-up of signal pressure. The bumper may be rotated to adjust the high load bump position at a specific output signal. In some pilot valve applications the jump-up of signal pressure triggers a sudden implement function such as float.

Note that the magnitude of the bump force is similar in one embodiment to the actuation force needed to go to the bump position. This is due to the high initial load of the spring plunger bumper. In other cases the jump-up of signal is not present and the high bump load is adjusted to a pre-determined position. Examples include construction equipment bucket raise and bucket rack-back implement functions. Typically those implement functions may not have the jump-up of signal but do have the hold coil near max angle. The de-latching force from an electro-magnetic hold coil is shown as negative force value. The de-latching force is the electronic coil latching minus the low load of the spring plunger plus the loads form the pilot valve and boot. Making the electric hold coil latching higher ads to package size, heat and cost. Because the spring plunger has a low final load this de-latching or hold force is preferably on the same magnitude as the full actuation force with a cost effective small hold coil.

Thus, one or more embodiments of the present invention provide 1) a bumper having final load much less than the initial load, 2) in a small, self-contained unit, and 3) with an improved spring system that reduced wear when returning the bumper to the pre-set condition. These embodiments address the above-mentioned issues and concerns by configuring both a return spring and a high load spring in a self-contained small position adjustable spring plunger unit. These embodiments may be similar in size to a conventional spring plunger only with much higher initial load and a much lower final load needed for some applications. The return spring may be low rate and low load and is predetermined to overcome actuation friction and return the plunger pin back to the neutral re-set position. This is desired to be a low force so the spring may be sized for high cycles in a small package due to the low loads. The initial high bump force spring may be high rate with a higher pre-load than the return spring. This higher pre-load is determined in conjunction with the ball ramp angle and the bump spring retainer angle such that the initial high load desired is obtained and the stress on the ball ramp is low enough for actuation durability.

The stroke of the high bump force spring is low and the rate is high so this spring may be sized for high cycles in a small package size. With both springs sized small they may be configured into a single body. This body may also be threaded to provide adjustment of the application bump contact position. This threaded portion may also have a thread locking provision. The thread is shown in FIG. 1D where the note points out thread locker such as Loctite 249. There are several thread locker solutions known in the art that may be applied to the thread allowing the adjusted position to stay in the adjusted position.

The maximum travel of the plunger pin is limited by a predetermined contact position of a shoulder on the pin with the body. This limits the stress to the return spring. After a bump actuation the return spring move the plunger pin back to the neutral or re-set position. A snap ring is attached to the top of the pin so that the parts are reliably retained in the re-set position.

The ball retainer ramp surface may be heat treated for durability. The plunger pin tip may also be heat treated and or made of work hardening material such as stainless steel.

The force versus displacement curve may have about twice the initial load as a similar size spring plunger. Then after actuation the load drops such that at a shifted position the plunge force is about twice as low as a similar size spring plunger. For reference the loads from a conventional similar sized spring plunger are also shown on the same plot. By comparison the high-low bumper has about twice the initial load and twice as low final load. This makes the high-low spring plunger bumper about 4 times (2×2) as effective as a similar sized conventional spring plunger, as shown in FIG. 5. A typical pilot control curve showing pressure and torque versus degree of actuation is shown in FIG. 6. The high-low spring plunger is adjusted prior to the jump-up of pilot pressure that may trigger a sudden function such as float. The final low plunger force then may improve the float latching holding torque.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

The invention claimed is:

1. A spring plunger bumper including:

an exterior body, wherein said exterior body includes a plurality of displacement ball retaining surfaces;

a plunger positioned slidably within said exterior body and positioned in an unloaded position, wherein said plunger includes:

a lower displacement ball inclined surface; and a lower displacement ball indent surface;

a displacement ball positioned between said plurality of displacement ball retaining surfaces of said exterior body;

a ramp sleeve positioned to contact said displacement ball;

a ramp sleeve spring to induce said ramp sleeve into contact with said displacement ball so that as said plunger is displaced, said ramp sleeve induces said displacement ball into contact with said lower displacement ball inclined surface of said plunger, wherein continued displacement of said plunger causes said ramp sleeve to induce said displacement ball into contact with said lower displacement ball indent surface of said plunger; and a return spring positioned between said plunger and said exterior body wherein said return spring induces said exterior body and said plunger to return to said unloaded position when said plunger is no longer displaced wherein said exterior body includes an exterior adjustment thread that is threaded into an external thread.

2. The spring plunger bumper of claim 1 wherein said exterior adjustment thread may be threaded or de-threaded into said external thread to adjust an initial contact of said plunger with an external surface.

3. The spring plunger bumper of claim 1 further including at least one additional displacement ball positioned between a second plurality of displacement ball retaining surfaces.

4. The spring plunger bumper of claim 3 wherein said at least one additional displacement ball also contacts said ramp sleeve.

5. The spring plunger bumper of claim 1 wherein said displacement ball retaining surfaces are angled at an angle other than radially from said spring plunger bumper.

6. The spring plunger bumper of claim 1 wherein said exterior body includes a max stop surface that contacts a plunger max stop surface to limit the position of the plunger within the exterior body.

7. The spring plunger bumper of claim 1 wherein the exterior body includes an abutment shoulder to prevent further threading of said exterior adjustment thread onto said external thread.

8. The spring plunger bumper of claim 1 wherein said lower displacement ball inclined surface is inclined.

9. The spring plunger bumper of claim 1 wherein the surface of said ramp sleeve is inclined.

10. The spring plunger bumper of claim 1 wherein one or more of said exterior body, said plunger, said displacement ball, said ramp sleeve, and said return spring have been treated with a friction reducing lubricant or surface treatment.

11. The spring plunger bumper of claim 1 wherein said plunger includes a pivoting ball embedded in a lower surface of said plunger.

12. An operator control system including at least one spring plunger bumper as recited in claim 1.

* * * * *